US011344772B2

(12) United States Patent
Gonzalez et al.

(10) Patent No.: US 11,344,772 B2
(45) Date of Patent: May 31, 2022

(54) WEIGHTED GOLF CLUB

(71) Applicant: Acushnet Company, Fairhaven, MA (US)

(72) Inventors: Oswaldo Gonzalez, San Jacinto, CA (US); Gery M. Zimmerman, Fallbrook, CA (US); Mami D. Ines, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/217,975

(22) Filed: Mar. 30, 2021

(65) Prior Publication Data

US 2021/0331042 A1 Oct. 28, 2021

Related U.S. Application Data

(60) Provisional application No. 63/013,949, filed on Apr. 22, 2020.

(51) Int. Cl.
*A63B 53/04* (2015.01)

(52) U.S. Cl.
CPC ..... *A63B 53/04* (2013.01); *A63B 2053/0491* (2013.01)

(58) Field of Classification Search
CPC ..... A63B 2053/0491; A63B 53/0475; A63B 53/047; A63B 53/04
USPC ..... 473/341, 334–336
See application file for complete search history.

(56) References Cited

U.S. PATENT DOCUMENTS

| | | | | |
|---|---|---|---|---|
| 4,695,054 | A * | 9/1987 | Tunstall | A63B 60/00 473/338 |
| 6,328,662 | B1 * | 12/2001 | Huang | A63B 53/0487 473/334 |
| 6,450,894 | B1 * | 9/2002 | Sun | A63B 53/0487 473/252 |
| 7,083,526 | B2 * | 8/2006 | Durnin | A63B 60/02 473/251 |
| 8,025,586 | B2 * | 9/2011 | Teramoto | A63B 53/0487 473/221 |
| 8,206,234 | B1 * | 6/2012 | Slater | A63B 53/0487 473/244 |
| 2002/0098908 | A1 * | 7/2002 | James | A63B 53/0487 473/324 |
| 2009/0258725 | A1 * | 10/2009 | Jones | A63B 53/0487 473/341 |
| 2011/0294597 | A1 * | 12/2011 | Teramoto | A63B 60/00 473/335 |
| 2020/0197767 | A1 * | 6/2020 | Morelock | A63B 60/02 |

* cited by examiner

*Primary Examiner* — John E Simms, Jr.
(74) *Attorney, Agent, or Firm* — Randy K. Chang

(57) ABSTRACT

A weighted golf club is disclosed herein. More specifically, a golf club head includes a chassis with a heel opening and a toe opening defined therein. A heel weight member is disposed within the heel opening and a toe weight member is disposed within the toe opening. The heel weight member and the toe weight member are securely mechanically attached to the chassis by a fastener.

17 Claims, 11 Drawing Sheets

WEIGHTED GOLF CLUB

CROSS-REFERENCE TO RELATED APPLICATIONS

The present application claims the benefit of and priority to U.S. Provisional Application No. 63/013,949, filed on Apr. 22, 2020, the disclosure of which is incorporated by reference in its entirety.

FIELD OF THE INVENTION

The present invention relates to a golf club, more particularly, to a golf club having weights mechanically fastened to a chassis of the golf club.

BACKGROUND

The point of golf is to get the ball into the hole in the fewest number of strokes possible. A golfer can improve not only through instruction and practice, but also by using golf clubs that are more forgiving, and therefore easier to hit straighter and further.

A conventional golf club generally includes a golf club head, a shaft, and a grip. The combined and individual weights of these components control the swing weight and feel of the golf club. While the total weight of a club head is fairly consistent between different designs, the weight of components within the club head may be manipulated by golf club designers to alter the performance of the golf club.

For example, golf club designers may reduce unnecessary mass from various portions of the golf club in order to strategically place mass in more desirable positions. Designers may reallocate this additional mass throughout the golf club head to manipulate both the center of gravity (CG) and the moment of inertia (MOI) of the golf club head. This mass is referred to as discretionary mass.

Some club designs include internal weights that are secured internally within a golf club body by adhesive, welding, swaging, or forging. Such weights are permanently affixed within the golf club body prior to the final assembly of the golf club. Such a construction has limitations including the lack of opportunity to precisely tune the mass of the golf club body at the time of golf club assembly. What is needed is a golf club body with weights that may be removably installed and adjusted before, during, and after the time of golf club assembly.

SUMMARY OF THE INVENTION

The systems, methods, and devices described herein have innovative aspects, no single one of which is indispensable or solely responsible for their desirable attributes. Without limiting the scope of the claims, some of the advantageous features will now be summarized.

According to an aspect of the present invention, a golf club head is provided that includes a chassis formed of a first material, said chassis including a heel, a toe opposite said heel, a topline, a sole opposite said topline, a hosel, and a rear wall; a striking face opposite said rear wall and coupled to said chassis; a heel weight member disposed within a heel opening defined in said chassis, said heel weight member being formed of a second material having a greater density than that of said first material; a toe weight member disposed within a toe opening defined in said chassis, said toe weight member being formed of a third material having a greater density than that of said first material; and a fastener mechanically coupling said heel weight member and said toe weight member with said chassis portion.

According to another aspect of the present invention, a golf club head is disclosed that includes a chassis including a heel, a toe opposite said heel, a topline, a sole opposite said topline, a hosel, a striking face, and a rear wall opposite said striking face; a center opening defined in said rear wall; a toe opening defined in said toe and configured to receive a toe weight member, wherein said toe weight member includes a toe mass portion having a shape corresponding to a shape of said toe opening, and a toe extension portion extending into said center opening; a heel opening defined in said heel and configured to receive a heel weight member, wherein said heel weight member includes a heel mass portion having a shape corresponding to a shape of said heel opening, and a heel extension portion extending into said center opening; a fastener mating with a fastener receiving hole defined in said chassis within said center opening to mechanically couple said toe weight member and said heel weight member with said chassis portion.

According to another aspect of the present invention a golf club head is provided that includes a chassis including a heel, a toe opposite said heel, a topline, a sole opposite said topline, a hosel, a striking face, and a rear wall opposite said striking face; a center opening defined in said chassis and configured to receive a housing, said center opening including a fastener receiving hole; a toe opening defined in said toe of said chassis and configured to receive a toe weight member, said toe opening comprising: a toe tab having grooves defined therein; and a center toe opening in communication with said center opening, wherein said toe weight member includes a toe mass portion having a shape corresponding to a shape of said toe opening, a toe extension portion extending into said center opening through said center toe opening, and a toe notch having a shape that corresponds with said toe tab; a heel opening defined in said heel of said chassis and configured to receive a heel weight member, said heel opening comprising: a heel tab having grooves defined therein; and a center heel opening in communication with said center opening, wherein said heel weight includes a heel mass portion having a shape corresponding to a shape of said heel opening, a heel extension portion extending into said center opening through said center heel opening, and a heel notch having a shape that corresponds with said heel tab; a housing configured to fit within said center opening, said housing comprising: a first recess having a shape corresponding to said toe extension portion; a second recess having a shape corresponding to said heel extension portion; and an opening aligned with said fastener receiving hole defined in said chassis; and a single fastener passing through each of said opening defined in said housing, said heel extension portion, and said toe extension portion and mating with threads defined in said fastener receiving hole.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

Figure 1:
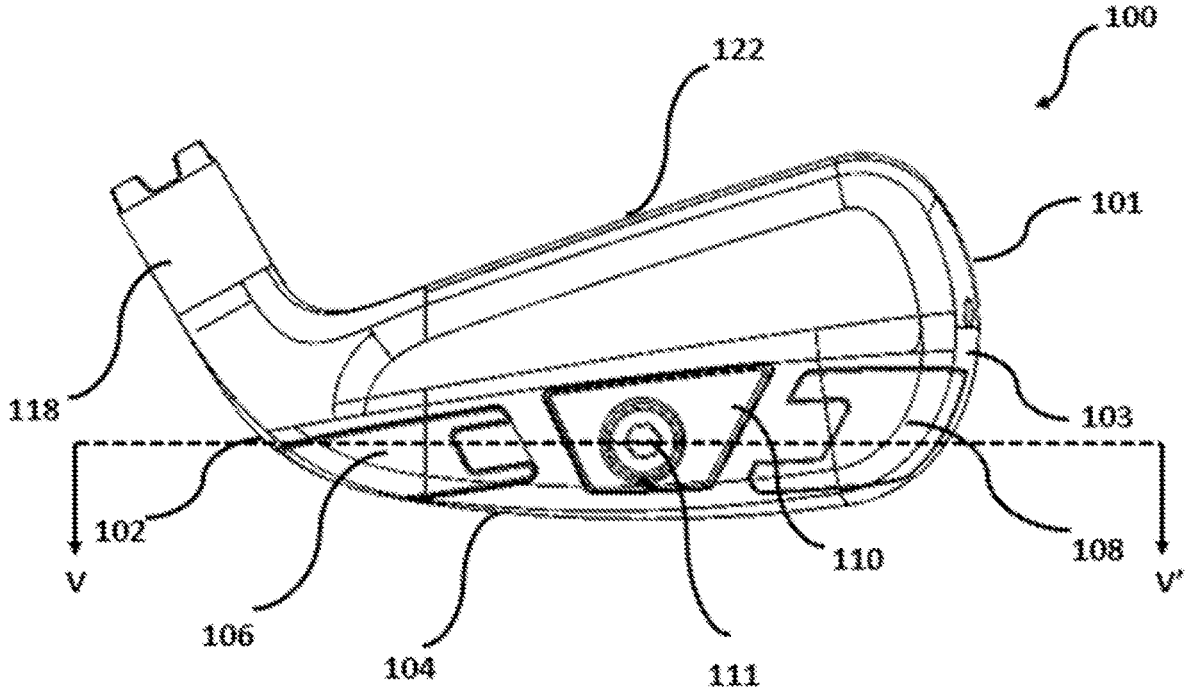
FIG. 1 shows a rear view of a golf club head in accordance with an exemplary embodiment of the present invention.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to golf clubs having an improved striking face. More specifically, some embodiments relate to golf club head constructions which normalize the characteristic time across a large portion of the striking face.

In describing the present technology herein, certain features that are described in the context of separate implementations also can be implemented in combination in a single implementation. Conversely, various features that are described in the context of a single implementation also can be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

The present invention includes a number of ways to attach weight members to a golf club head, such that the weight members and the head can be manufactured and finished separately, while being mechanically couplable.

Figure 2:
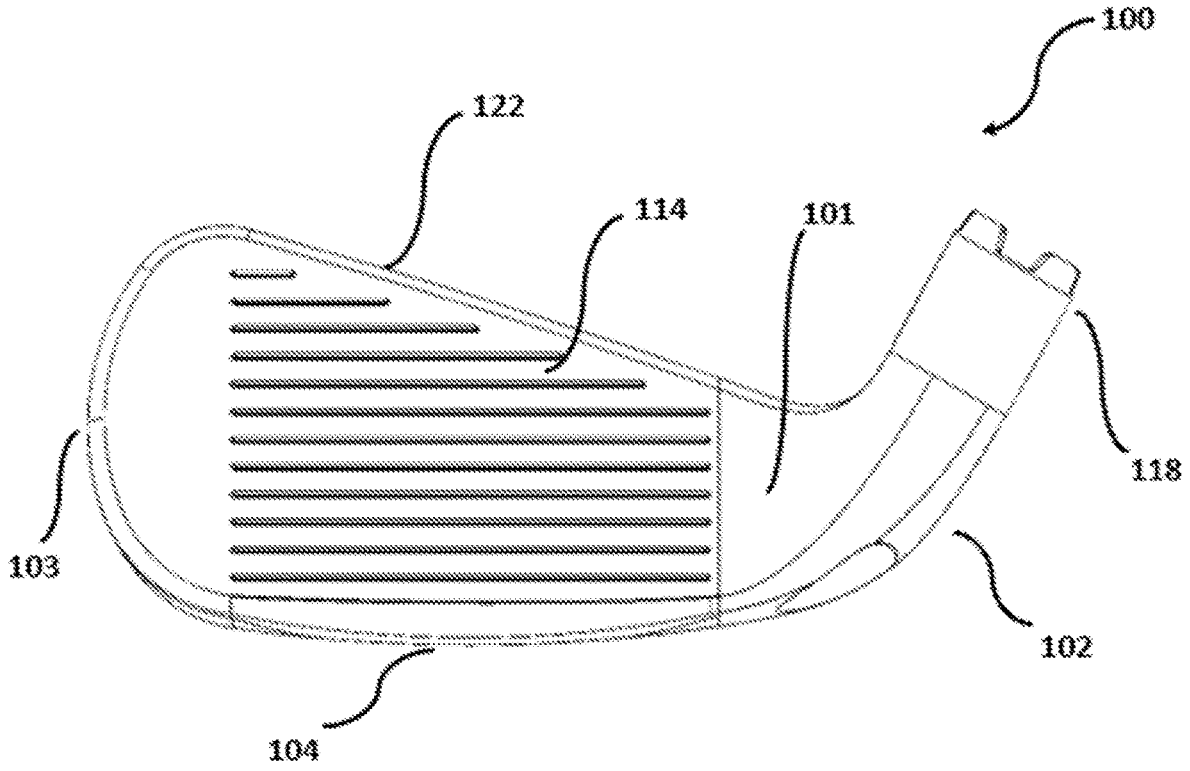
FIG. 2 shows a front view of a golf club head in accordance with an exemplary embodiment of the present invention.

Referring to FIGS. 1-2, an embodiment of a weighted golf club 100 in accordance with the present invention is disclosed. FIG. 1 is a rear view of the weighted golf club 100 and FIG. 2 is a front view of the weighted golf club 100.

According to an embodiment of the present invention, the weighted golf club 100 may be a hollow body-type golf club, e.g., an iron, a hybrid, a metalwood, or a putter. For the purpose of illustration, the present invention is shown as implemented as a hollow-bodied iron-type golf club.

As illustrated in FIGS. 1-2, the weighted golf club 100 includes a chassis 101, a striking face 114, and a hosel 118. The chassis 101 includes a heel 102, a toe 103 opposite said heel 102, a topline 122, and a sole 104 opposite said topline 122.

The weighted golf club 100 may further include a heel weight member 106 disposed in the heel 102 of the chassis 101, a toe weight member 108 disposed in a toe 103 of the chassis 101, and a housing 110 disposed in a central portion of the chassis 101 interposed between the heel 102 and the toe 103. The housing 110 may be secured to the chassis 101 by a fastener 111 and will be described in greater detail below.

While the scope of the present invention is not limited to particular materials, benefits of the present invention may be best realized when the heel weight member 106 and the toe weight member 108 are formed of a material that is denser than that those of the rest of the golf club 100. For example, the chassis 101 and the striking face 114 may be formed of strong but light material such as steel, a steel alloy, or titanium, while the heel weight member 106 and the toe weight member 108 may be formed of a high-density material such as tungsten. Through this configuration, the present invention may best utilize the discretionary weight of the heel weight member 106 and the toe weight member 108. It is within the scope of the invention for the chassis 101 to have a first density, the heel weight member 106 to have a second density, and the toe weight member 108 to have a third density. The heel weight member 106 and the toe weight member 108 may have the same density or different densities, and one or more of the heel weight member 106 and the toe weight member 108 may have a density less than that of the chassis 101.

Figure 3:
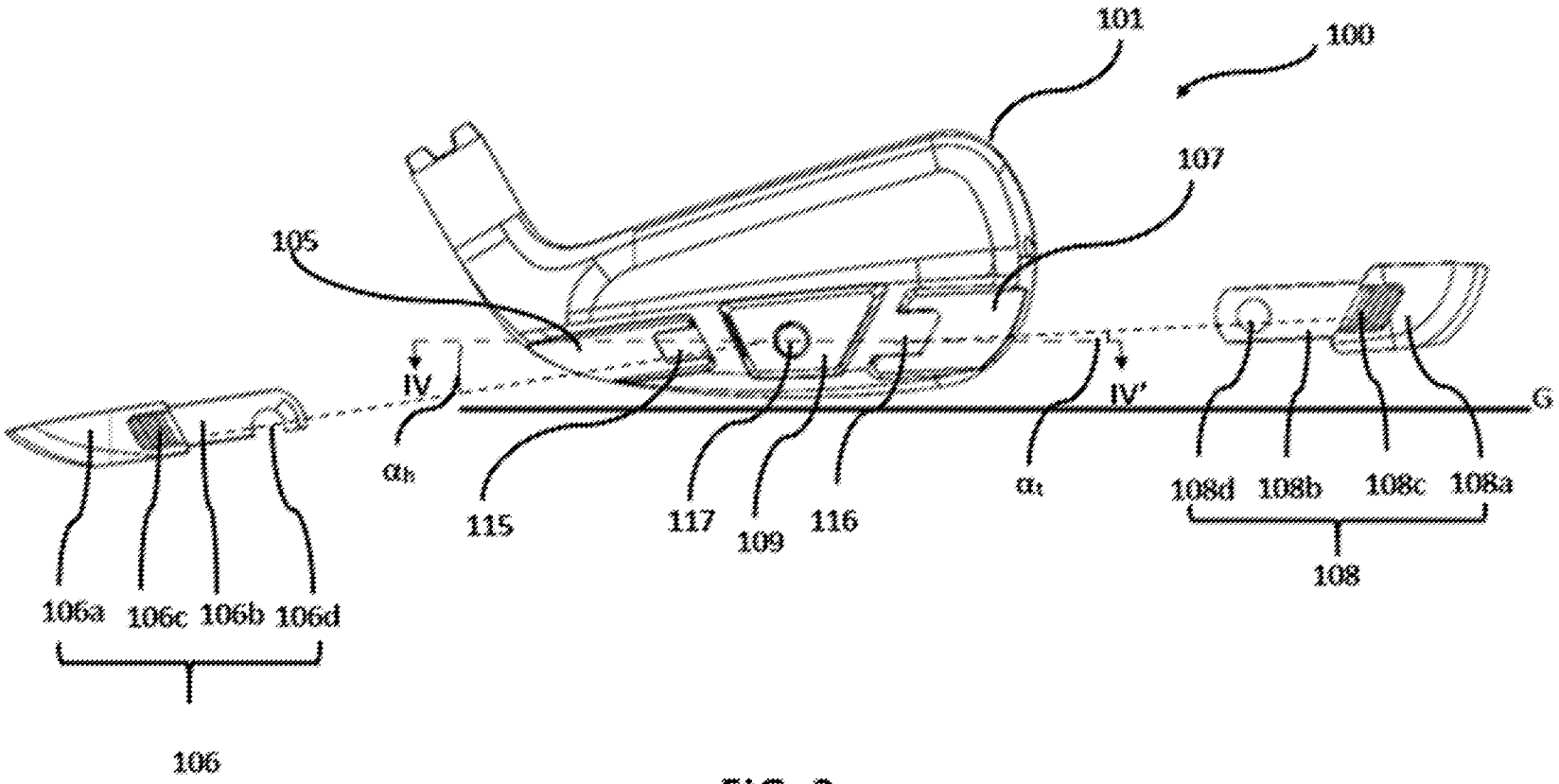
FIG. 3 shows an exploded rear view of a golf club head in accordance with an exemplary embodiment of the present invention.

Referring to FIG. 3, portions of the weighted golf club 100 are shown in an exploded rear view to better illustrate some features of the present invention. Specifically, FIG. 3 shows the heel weight member 106 and the toe weight member 108 separated from the chassis 101.

As illustrated in FIG. 3, the chassis 101 may further include a heel opening 105, a heel tab 115, a toe opening 107, a toe tab 116, a center opening 109, and a fastener receiving hole 117.

The heel weight member 106 may further include a heel mass portion 106*a*, a heel extension portion 106*b*, a heel notch 106*c*, and a heel fastener receiving opening 106*d*. While the heel fastener opening 106*d* is shown as not being fully enclosed, it is also within the scope of the present invention for the heel fastener opening 106*d* to be fully enclosed depending on an insertion angle of the heel weight member 106 within the chassis 101 and the position of the fastener receiving hole 117 within the center opening 109.

The toe weight member 108 may further include a toe mass portion 108*a*, a toe extension portion 108*b*, a toe notch 108*c*, and a toe fastener receiving opening 108*d*. While the toe fastener opening 108*d* is shown as not fully enclosed, it is also within the scope of the present invention for the toe fastener opening 108*d* to not be fully enclosed depending on an insertion angle of the toe weight member 108 within the chassis 101 and the position of the fastener receiving hole 117 within the center opening 109.

Figure 4:
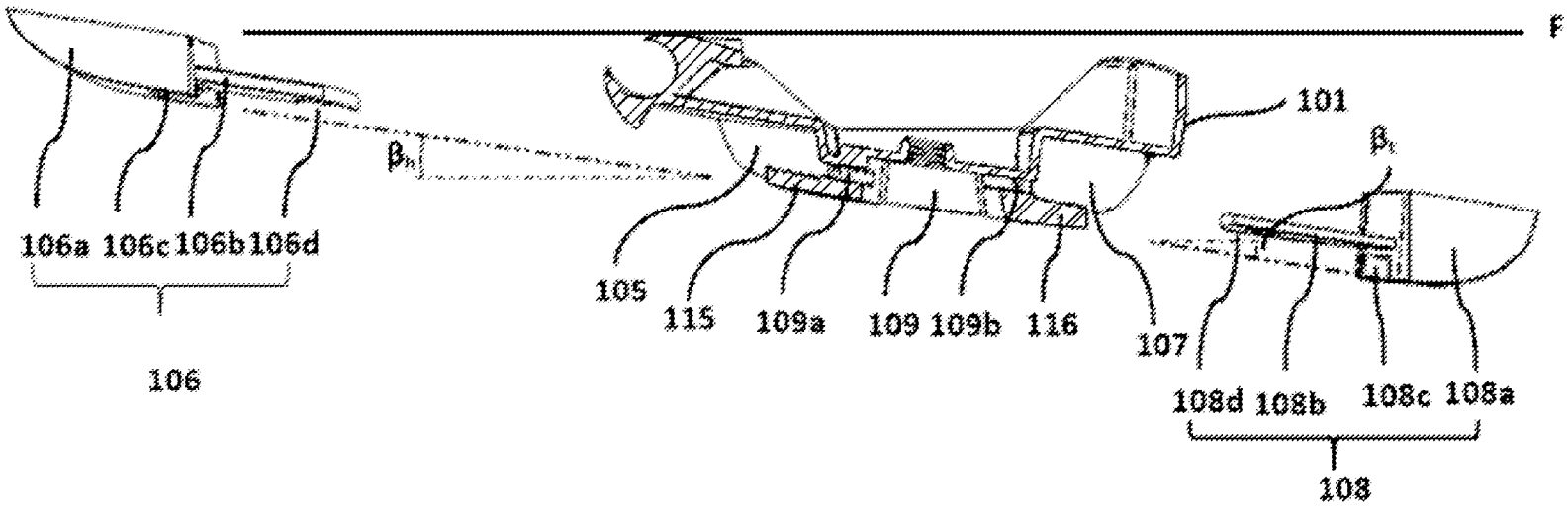
FIG. 4 shows an exploded cross-sectional view of a golf club head in accordance with an exemplary embodiment of the present invention taken along the cross-sectional line IV-IV' shown in FIG. 3.

As shown in FIGS. 3 and 4, the heel opening 105 is configured to receive the heel weight member 106. The heel weight member 106 may be inserted into the chassis 101 through the heel opening 105 in a generally heel-toe direction. FIGS. 3 and 4 illustrate an insertion direction along the dotted line connecting the heel weight member 106 and the heel opening 105; however, it should be noted that the present invention is not limited in this regard.

As shown in FIG. 3 the heel weight member 106 is inserted into the heel opening 105 at an angle $\alpha_h$ relative to a ground plane G when the weighted golf club 100 is held in a normal address position.

According to an embodiment of the present invention, $\alpha_h$ may less than about +/−75° relative to the ground plane G, preferably $\alpha_h$ may be less than about +/−30° relative to the ground plane G, most preferably $\alpha_h$ may be less than about +/−10° relative to the ground plane G.

Referring to FIG. 4, a top-down cross-sectional view of the weighted golf club 100 is shown taken along the line IV-IV' as shown in FIG. 3. It is noted that the striking face 114, the housing 110, and the fastener 111 are omitted from FIG. 4 for clarity. As shown in FIG. 4 the heel weight member 106 is inserted into the heel opening 105 at angle $\beta_h$ relative to a vertical plane F that is perpendicular to the ground plane G and parallel to a leading edge of the striking face 114.

According to an embodiment of the present invention, $\beta_h$ may be less than about +/−75° relative to the vertical plane F, preferably, $\beta_h$ may be less than about +/−30° relative to the vertical plane F, and most preferably, $\beta_h$ may be less than about +/−10° relative to the vertical plane F.

As shown in FIGS. 3 and 4, the toe opening 107 is configured to receive the toe weight member 108. The toe weight member 108 may be inserted into the chassis 101 through the toe opening 107 in a generally heel-toe direction. FIGS. 3 and 4 illustrate an insertion direction along the dotted line connecting the toe weight member 108 and the toe opening 107; however, it should be noted that the present invention is not limited in this regard.

As shown in FIG. 3 the toe weight member 108 is inserted to the toe opening 107 at an angle $\alpha_t$ relative to the ground plane G when the weighted golf club 100 is held in a normal address position.

According to an embodiment of the present invention, $\alpha_t$ may be less than about +/−75° relative to the ground plane G, preferably $\alpha_t$ may be less than about +/−30° relative to the ground plane G, and most preferably $\alpha_t$ may be less than about +/−10° relative to the ground plane G.

As shown in FIG. 4 the toe weight member 108 is inserted into the toe opening 107 at angle $\beta_t$ relative to a vertical plane F that is perpendicular to the ground plane G and parallel to a leading edge of the striking face 114.

According to an embodiment of the present invention, $\beta_t$ may be less than about +/−75° relative to the vertical plane F, preferably, $\beta_t$ may be less than about +/−30° relative to the vertical plane F, and most preferably, $\beta_t$ may be less than about +/−10° relative to the vertical plane F.

FIG. 3 illustrates several features of the presently claimed invention that ensure that the heel weight member 106 and the toe weight member 108 are securely fastened to the chassis 101. It is noted that it is critical that the heel weight member 106 and the toe weight member 108 be securely fastened to the chassis 101, as failure to do may result in an undesirable rattle or physical failure.

First, the heel mass portion 106*a* of the heel weight member 106 and the toe mass portion 108*a* of the toe weight member 108 are contoured to blend substantially seamlessly with the contours of the chassis 101 both inside and outside of the heel opening 105 and the toe opening 107. That is, the shape of the heel mass portion 106*a* and the shape of the toe mass portion 108*a* correspond to the shape of the heel opening 105 and the shape of the toe opening 107, respectively.

Alternatively, though not illustrated, the weighted golf club 100 may further include a cover member that attaches to a rear portion of the chassis 101 to conceal one or more of the heel weight member 106, the toe weight member 108, and the housing 110.

Second, the heel weight member 106 may be further secured to the chassis 101 by a heel tab 115 that extends generally along the insertion direction of the heel weight member 106 along a rear surface of the chassis 101. As shown in FIG. 3, a heel notch 106*c* may be formed in the heel mass portion 106*a* of the heel weight member 106 to receive the heel tab 115 when the heel weight member 106 is inserted into the heel opening 105. The heel notch 106*c* and the heel tab 115 have complimentary shapes to enhance the structural integrity of the fastening of the heel weight member 106 within the heel opening 105. Alternatively, though not illustrated, the heel notch 106*c* may be formed in the heel extension portion 106*b* of the heel weight member 106.

According to an embodiment of the present invention, the heel notch 106*c* and the heel tab 115 may each include grooves formed on respective mating surfaces to further enhance the structural integrity of the fastening of the heel weight member 106 within the heel opening 105. The combination of grooves may constitute a ratchet mechanism that freely allows for movement of the heel weight member 106 along the insertion direction, but inhibits movement in a removal direction being opposite the insertion direction.

The toe weight member 108 may similarly be secured to the chassis 101 by a toe tab 116 that extends generally along the insertion direction of the toe weight member 108 along a rear surface of the chassis 101. As shown in FIG. 3, a toe notch 108*c* may be formed in the toe mass portion 108*a* of the toe weight member 108 to receive the toe tab 116 when the toe weight member 108 is inserted into the toe opening 107. The toe notch 108*c* and the toe tab 116 have complimentary shapes and therefore enhance the structural integrity of the fastening of the toe weight member 108 within the toe opening 107. Alternatively, though not illustrated, the toe notch 108*c* may be formed in the toe extension portion 108*b* of the toe weight member 108.

According to an embodiment, the toe notch 108*c* and the toe tab 116 may each include grooves formed on respective mating surfaces to further enhance the structural integrity of the fastening of the toe weight member 108 within the toe opening 107. The grooves may constitute a ratchet mechanism that freely allows for movement of the toe weight member 108 along the insertion direction, but inhibits movement in a removal direction being opposite the insertion direction.

Referring back to FIG. 4, the cross-sectional view of FIG. 4 illustrates a third feature of the present invention that further enhances the securing of the heel weight member 106 within the heel opening 105 and the toe weight member 108 within the toe opening 107.

As shown in FIG. 4, the heel opening 105 is connected to the center opening 109 by a center heel opening 109*a*. The center heel opening 109*a* is configured to receive the heel extension portion 106*b* of the heel weight member 106. The center heel opening 109*a* and the heel extension portion 106*b* have corresponding shapes such that the center heel opening 109*a* has the same height and width as that of the heel extension portion 106*b*, and therefore further enhances the structural integrity of the of the fastening of the heel weight member 106 within the heel opening 105.

The toe opening 107 is connected to the center opening 109 by a center toe opening 109*b*. The center toe opening 109*b* is configured to receive the toe extension portion 108*b* of the toe weight member 108. The center heel opening 109*a* and the toe extension portion 108*b* have corresponding shapes such that the center toe opening 109*b* has the same height and width as that of the toe extension portion 108*b*, and therefore further enhances the structural integrity of the of the fastening of the toe weight member 108 within the toe opening 107.

FIG. 4 also better illustrates the grooves formed on the heel tab 115 and the toe tab 116.

A fourth feature that enhances the structural integrity of the mechanical fastening of the heel weight member 106 and the toe weight member 108 with the chassis 101 is illustrated in FIG. 4.

As shown in FIG. 4, with respect to the vertical plane F, the insertion directions of the heel weight member 106 and the toe weight member 108 are substantially parallel to each other. Moreover, the center heel opening 109*a* and the center toe opening 109*b* are offset from each other relative to the vertical plane F so that upon insertion into the chassis 101, the heel extension portion 106*b* of the heel weight member 106 and the toe extension portion 108*b* of the toe weight member 108 overlap in a face-rear direction with substantially no separation. As an alternative, the heel extension portion 106*b* of the heel weight member 106 and the toe extension portion 108*b* of the toe weight member 108 may be separated by a gap and a damping material may be interposed therebetween. The damping layer may be secured by friction and/or an adhesive layer may be applied to one or more surfaces of the damping layer. The damping layer may reduce vibrations and therefore sounds, while also easing manufacturing tolerance requirements.

Figure 5:
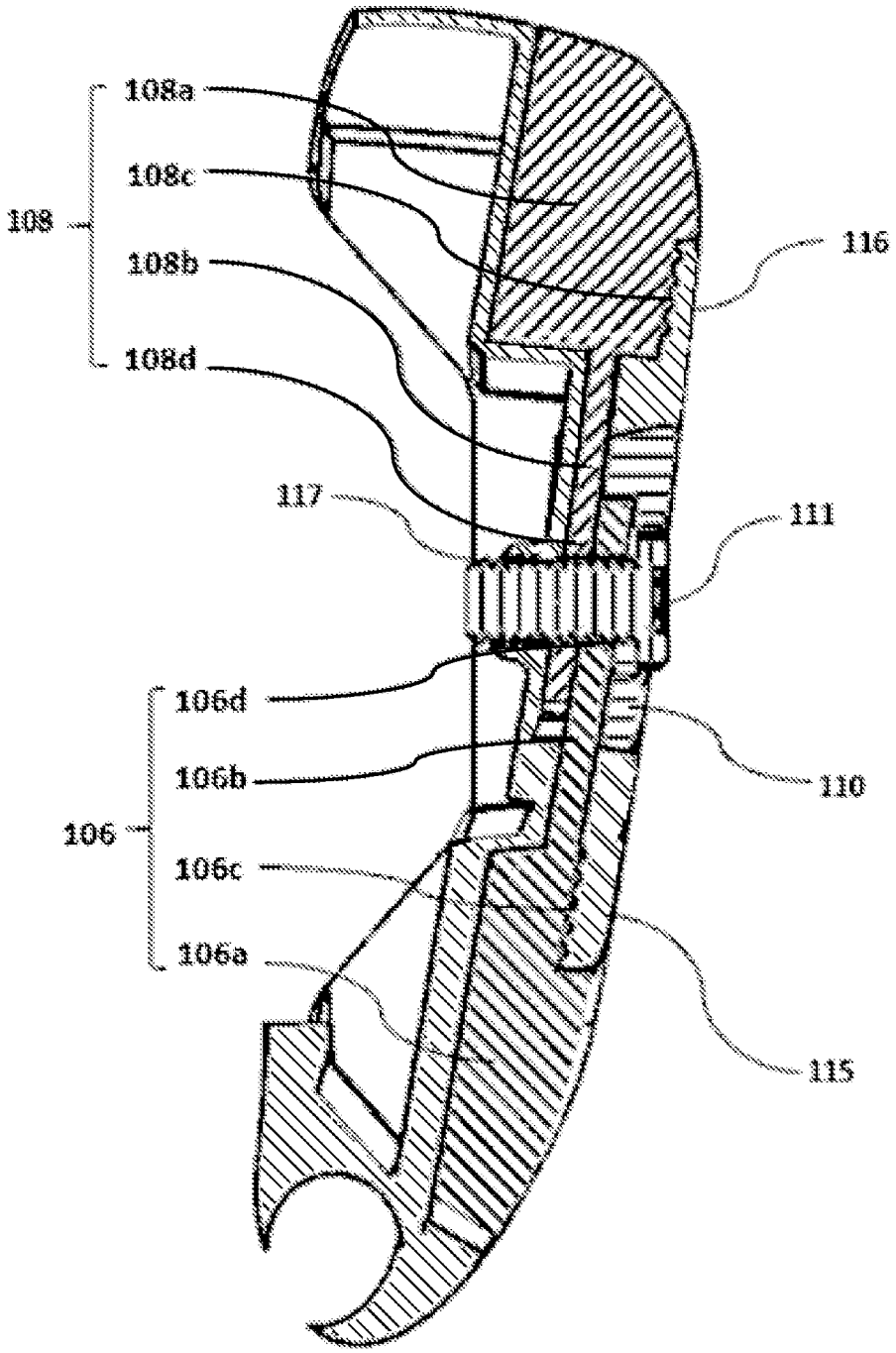
FIG. 5 shows a cross-sectional view of a chassis of a golf club head in accordance with an exemplary embodiment of the present invention taken along the cross-sectional line V-V' shown in FIG. 1.

Referring to FIG. 5, a top-down cross-sectional view along the line V-V' of FIG. 1 illustrates a fifth feature that enhances the structural integrity of the mechanical fastening of the heel weight member 106 and the toe weight member 108 with the chassis 101. As shown in FIG. 5, the fastener 111 passes through each of the housing 110, heel fastener receiving opening 106*d* of the heel weight member 106, the toe fastener receiving opening 108*d* of the toe weight member 108, and the fastener receiving hole 117 of the chassis 101. According to an embodiment, the fastener 111 may have threads that mate with threads defined in a surface of the fastener receiving hole 117. When the fastener 111 is fully seated within the fastener receiving hole 117, the fastener 111 and the chassis 101 apply a compressive force through each of the housing 110, the heel extension portion 106*b*, and the toe extension portion 108*b*. In an alternative embodiment, additional damping layers may be interposed between the interface of the chassis 101 and the toe extension portion 108*b*, between the interface of the housing 110 with the heel extension portion 106*b*, between the interface of the housing 110 with the toe extension portion 108*b*, and/or between the interface of a head of the fastener 111 and the housing 110. The additional damping layers maybe secured by friction and/or an adhesive layer may be applied to one or more surfaces of any of the damping layers. The additional damping layer may reduce vibrations and therefore sounds, while also easing manufacturing tolerance requirements.

FIG. 5 illustrates how the ends of heel extension portion 106*b* of the heel weight member 106 and the toe extension portion 108*b* of the toe weight member 108 overlap in a face-rear direction with substantially no separation when fully inserted into the chassis 101.

FIG. 5 also illustrates how the heel fastener receiving opening 106*d* of the heel weight member 106 and the toe fastener receiving opening 108*d* of the toe weight member 108 align with the fastener receiving hole 117. The fastener 111 not only applies a compressive force as described above, but also prevents each of the housing 110, the heel weight member 106, and the toe weight member 108 from moving relative to the chassis 101.

Figure 6:
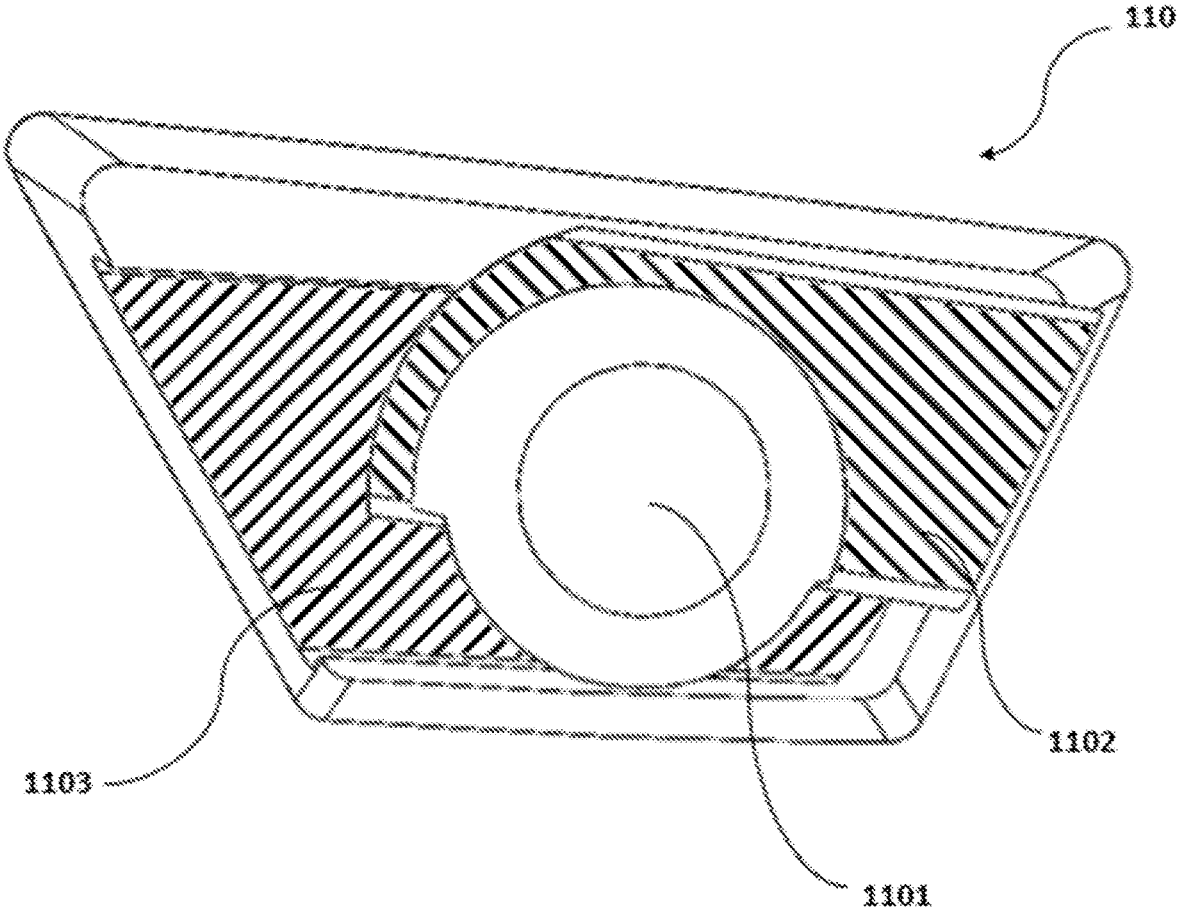
FIG. 6 shows a front view of a housing in accordance with an exemplary embodiment of the present invention.

Referring to FIG. 6, a front view of the housing 110 is provided to better illustrate the structure of the housing 110. The housing 110 may be formed of any material. Preferably, the housing 110 is formed of a material that has a density less than that of the chassis 101 to best utilize discretionary mass; however it is also within the scope of the invention for the density of the housing 110 to be equal or greater than that of the chassis 101. According to an embodiment of the present invention, the housing 110 may be formed of a composite material or a polymer such as urethane. A housing 110 formed of urethane is less dense than the chassis 101 and also reduces sounds generated by other elements of the weighted golf club 100. As shown in FIG. 6, an opening 1101 is defined through the housing 110 to receive the fastener 111. The housing 110 also includes a first recess 1102 for receiving the heel extension portion 106*b* of the heel weight member 106 and a second recess 1103 for receiving the toe extension portion 108*b* of the toe weight member 108.

As shown in FIG. 6, the first recess 1102 has a greater depth than the second recess 1103. The difference in depth of the first recess 1102 and the second recess 1103 corresponds to the slight offset in the face-rear direction between the heel extension portion 106*b* of the heel weight member 106 and the toe extension portion 108*b* of the toe weight member 108 when fully inserted into the chassis 101.

This configuration is not limiting, and it is within the scope and spirit of the present invention for the second recess 1103 to have a depth that is greater than that of the first recess 1102. In such an alternative configuration, the offset between the center heel opening 109*a* and the center toe opening 109*b* and the offset between the heel extension portion 106*b* and the toe extension portion 108*b* are correspondingly reversed as well.

Figure 7:
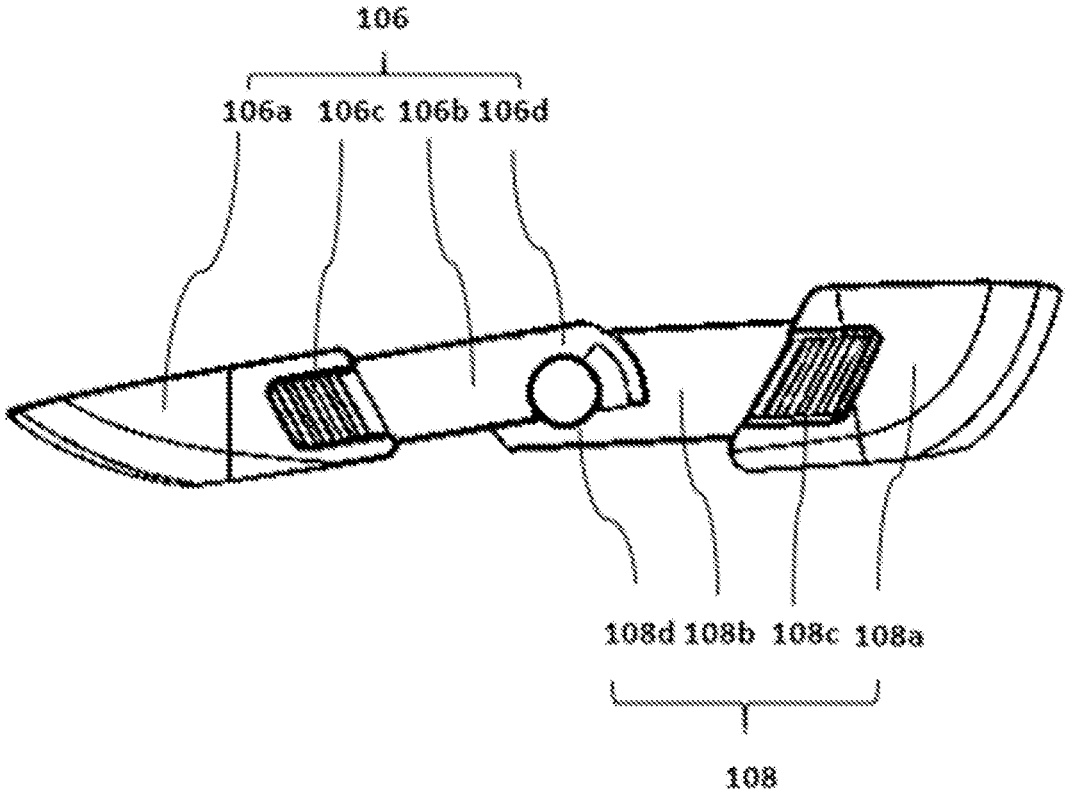
FIG. 7 shows a rear view of a heel weight member and a toe weight member in accordance with an exemplary embodiment of the present invention.

Referring to FIG. 7, a rear view of the heel weight member 106 and the toe weight member 108 is provided. By showing just the heel weight member 106 and the toe weight member 108, while omitting the other elements of the weighted golf club 100, the manner in which the heel weight member 106 and the toe weight member 108 are secured by the fastener (not shown) is more clearly illustrated. As shown in FIG. 7, the heel fastener receiving opening 106*d* of the heel weight member 106 and the toe fastener receiving opening 108*d* collectively form an opening for the fastener 111 to pass through. Moreover, when FIGS. 7 and 8 are considered together, it is clear how the housing 110 is configured to receive and support both the heel extension portion 106*b* of the heel weight member 106 and the toe extension portion 108*b* of the toe weight member 108, and it is clear how the opening 1101 of the housing 110, the heel fastener receiving opening 106*d* of the heel weight member 106, and the toe fastener receiving opening 108*d* of the toe weight member 108 align when fully inserted into the chassis 101.

Figure 8:
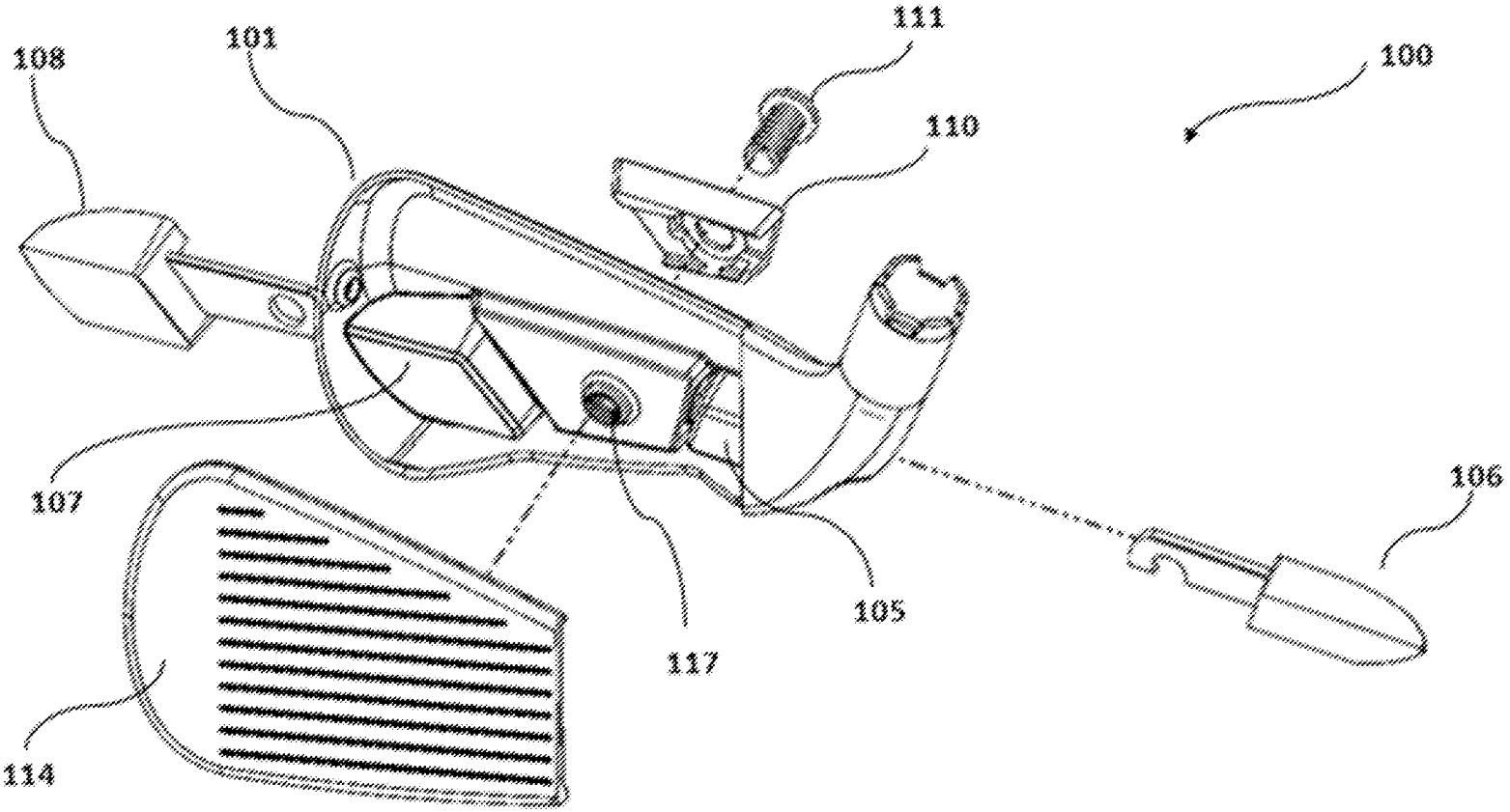
FIG. 8 shows an exploded front perspective view of a golf club head in accordance with an exemplary embodiment of the present invention.
Figure 9:
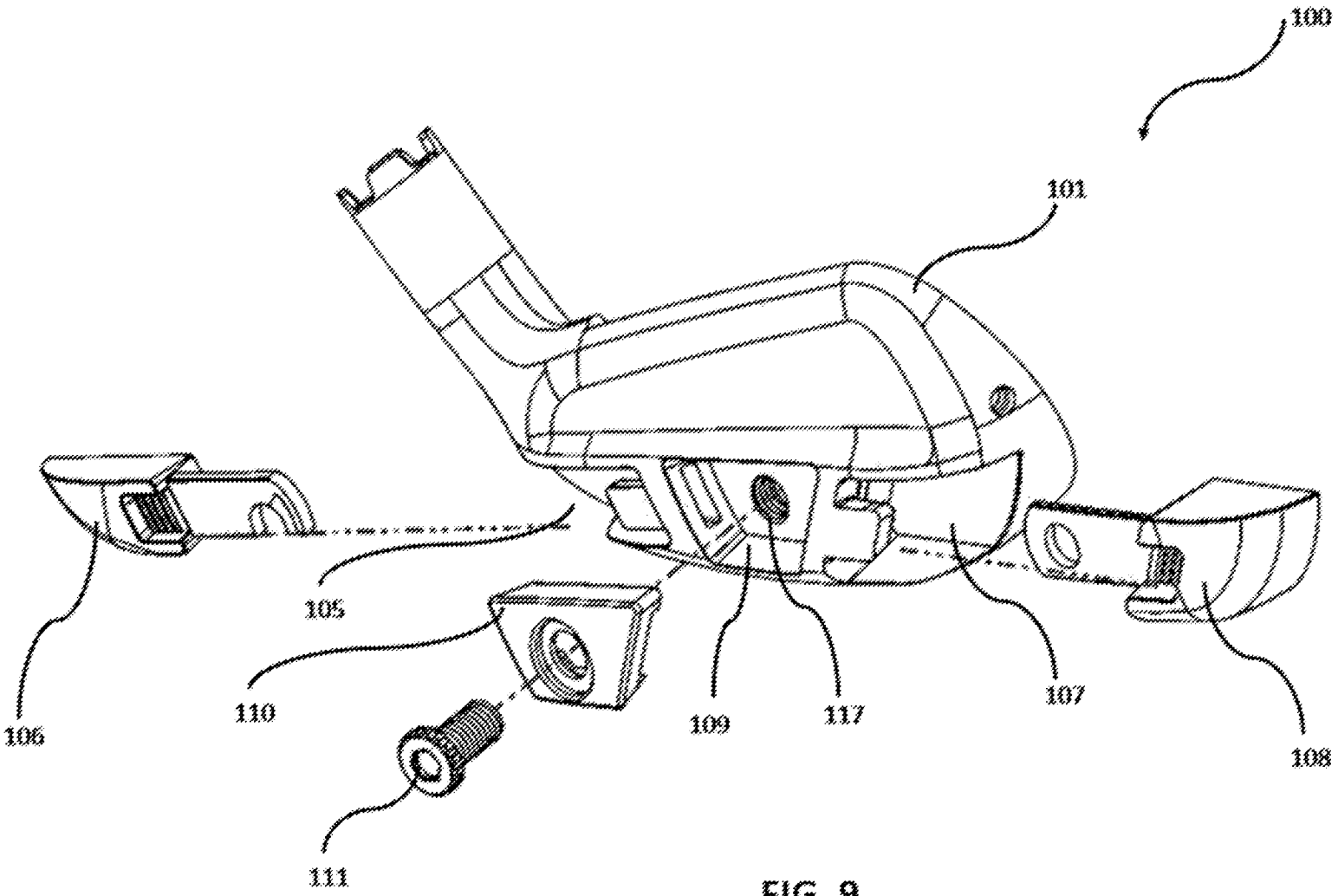
FIG. 9 shows an exploded rear perspective view of a golf club in accordance with an exemplary embodiment of the present invention.

Referring to FIGS. 8 and 9, additional exploded views of the weighted golf club 100 are provided to better illustrate additional features of the present invention. FIG. 8 provides an exploded frontal perspective view of the weighted golf club 100 and FIG. 9 provides an exploded rear view of the weighted golf club 100.

As shown in FIG. 8, the portions of the chassis 101 that form the walls of the heel opening 105 and the toe opening 107 extend into the interior of the chassis 101 but do not contact the striking face 114. As described above, the fastener 111 passes through the opening 1101 of the housing 110, the heel fastener receiving opening 106*d* of the heel weight member 106, and the toe fastener receiving opening 108*d* of the toe weight member 106, and mates with the threads of the fastener receiving hole 117 defined in the chassis 101. A minimum length of the fastener 111 is at least equal to a length that allows for mating of the fastener 111 with the fastener receiving hole 117, and a maximum length of the fastener 111 is less than or equal to a length that allows for the fastener 111 to contact a rear surface of the striking face 114 when the fastener 111 is fully inserted into the chassis 101. According to some embodiments, a polymer layer (not shown) may be interposed between the fastener 111 and a rear surface of the striking face 114. In such embodiments the fastener 111 may exert a force against the rear surface of the striking face 114 through the polymer layer to support the striking face 114, but still allow the striking face 114 to flex upon striking a golf ball (not shown).

Referring to FIG. 9, a rear perspective exploded view of the weighted golf club 100 affords additional views of the portions of the chassis 101 that define the heel opening 105, the toe opening 107, and the center opening 109.

Figure 10:
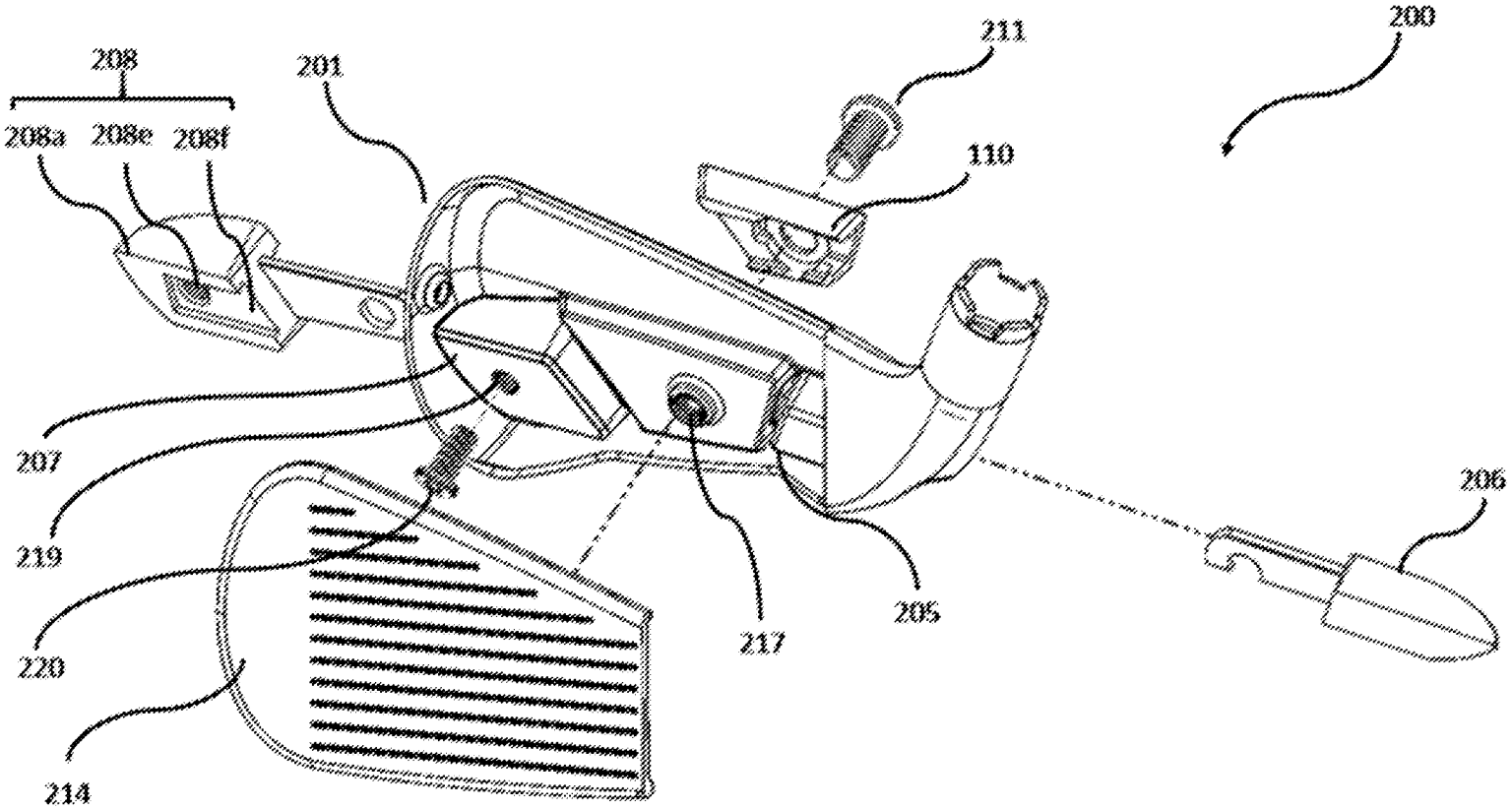
FIG. 10 shows an exploded front perspective view of a golf club head in accordance with another exemplary embodiment of the present invention.
Figure 11:
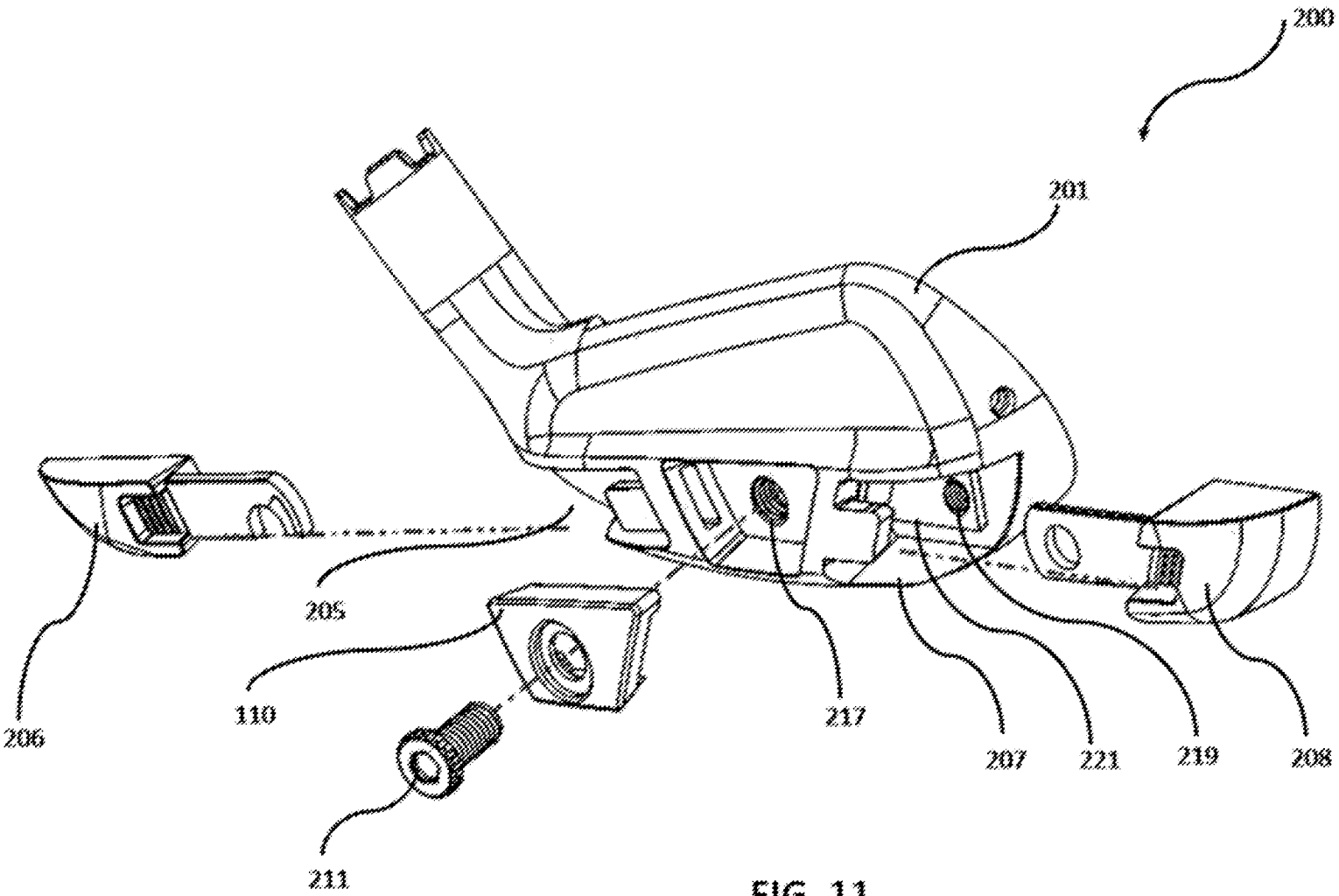
FIG. 11 shows an exploded rear perspective view of a golf club head in accordance with another exemplary embodiment of the present invention.

Referring to FIGS. 10 and 11 a weighted golf club 200 in accordance with an alternative embodiment is provided. FIG. 10 shows a frontal perspective exploded view of the weighted golf club 200 and FIG. 11 shows a rear perspective exploded view of the weighted golf club 200.

The weighted golf club 200 includes additional features that allow for further enhancements to the structural integrity of the weighted golf club 200. Like reference numerals are used in describing the weighted golf club 200, and the description of like elements of the weighted golf club 200 is omitted where such description is not necessary.

In the exemplary embodiment shown in FIG. 10 a second toe fastener receiving hole 208*e* is defined in the toe mass portion 208*a* of the toe weight member 208. When the toe weight member 208 is fully inserted into the toe opening 207, a second fastener 220 may be inserted through a hole 219 defined in a surface of the toe opening 207 and may be mated with corresponding threads defined in a surface of the second toe fastener receiving hole 208*e*. The second fastener 220 has a length that is less than or equal to a length that allows for the second fastener 220 to contact a rear surface of the striking face 214 when the second fastener 220 is fully inserted into the chassis 201.

Toe weight member 208 may also include a recess 208*f* defined in a surface thereof that will be discussed in further detail with reference to FIG. 11.

Referring to FIG. 11, a projection 221 is defined in a surface of the toe opening 207. Projection 221 has a shape that corresponds with that of recess 208*f* defined in toe weight member 208 as shown in FIG. 10. According to an exemplary embodiment of the present invention, the projection 221 interlocks with the recess 208*f* to add further structural integrity to the fastening of the toe weight member 208 to the chassis 201. For example, the projection 221 and the recess 208*f* may constitute a dovetail joint, but the present invention is not limited in this regard.

As shown in FIGS. 10 and 11, these features complement the fastener 211 and the housing 110 in securing the heel weight member 206 and the toe weight member 208 within the chassis 201.

While the second toe fastener receiving hole 208*e* and the recess 208*f* are shown and described as being defined in the toe weight member 208. It is within the scope of the present invention for similar elements to be defined in either one or both of the heel weight member 206 and the toe weight member 208 with corresponding holes being defined in the heel opening 205 and toe opening 207 without departing from the scope of the present invention.

In describing the present technology herein, certain features that are described in the context of separate implementations also can be implemented in combination in a single implementation. Conversely, various features that are described in the context of a single implementation also can be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

What is claimed is:

1. A golf club head comprising:

a chassis formed of a first material, said chassis including a heel, a toe opposite said heel, a topline, a sole opposite said topline, a hosel, and a rear wall;

a striking face opposite said rear wall and coupled to said chassis;

a heel weight member disposed within a heel opening defined in said chassis, said heel weight member being formed of a second material having a greater density than a density of said first material, wherein said heel weight member comprises a heel mass portion and a heel extension portion;

a toe weight member disposed within a toe opening defined in said chassis, said toe weight member being formed of a third material having a greater density than that of said first material, wherein said toe weight member comprises a toe mass portion and a toe extension portion;

a fastener mechanically coupling said heel weight member and said toe weight member with said chassis; and a housing disposed within a center opening interposed between said heel opening and said toe opening, wherein said center opening is connected to said heel opening by a center heel opening and said center opening is connected to said toe opening by a center toe opening, wherein said heel extension portion extends through said center heel opening into said center opening and said toe extension portion extends through said center toe opening into said center opening, wherein said fastener passes through each of said housing, said heel extension portion, and said toe extension portion, and mates with a fastener receiving hole defined in said chassis within said center opening.

2. The golf club head of claim 1, wherein said heel mass portion has a shape corresponding to said heel opening and said toe mass portion has a shape corresponding to said toe opening.

3. The golf club head of claim 2, wherein said heel mass portion includes a heel notch and said chassis includes a heel tab that mates with said heel notch, and wherein said toe mass portion includes a toe notch and said chassis includes a toe tab that mates with said toe notch.

4. The golf club head of claim 3, wherein complimentary grooves are defined in said heel notch and said heel tab and complimentary grooves are defined in said toe notch and said toe tab.

5. The golf club head of claim 1, wherein said housing comprises a first recess having a shape corresponding to said heel extension portion and a second recess having a shape corresponding to said toe extension portion.

6. The golf club head of claim 1, wherein a second fastener receiving hole is defined said toe mass portion, and a second fastener passes through a hole defined in said chassis within said toe opening and mates with threads defined in said second fastener receiving hole.

7. The golf club head of claim 1, wherein said toe mass portion includes a recess and said toe opening includes a projection, and wherein said recess and said projection constitute a dovetail joint.

8. A golf club head comprising:

a chassis including a heel, a toe opposite said heel, a topline, a sole opposite said topline, a hosel, a striking face, and a rear wall opposite said striking face;

a center opening defined in said rear wall;

a toe opening defined in said toe and configured to receive a toe weight member, wherein said toe weight member includes a toe mass portion having a shape corresponding to a shape of said toe opening, and a toe extension portion extending into said center opening;

a heel opening defined in said heel and configured to receive a heel weight member, wherein said heel weight member includes a heel mass portion having a shape corresponding to a shape of said heel opening, and a heel extension portion extending into said center opening; and a fastener mating with a fastener receiving hole defined in said chassis within said center opening to mechanically couple said toe weight member and said heel weight member with said chassis.

9. The golf club head of claim 8, wherein said heel mass portion includes a heel notch and said chassis includes a heel tab that mates with said heel notch, and wherein said toe mass portion includes a toe notch and said chassis includes a toe tab that mates with said toe notch.

10. The golf club head of claim 9, wherein complimentary grooves are defined in said heel notch and said heel tab and complimentary grooves are defined in said toe notch and said toe tab.

11. The golf club head of claim 8, further comprising a housing disposed within said center opening interposed between said heel opening and said toe opening, wherein said center opening is connected to said heel opening by a center heel opening and said center opening is connected to said toe opening by a center toe opening, wherein said heel extension portion extends through said center heel opening into said center opening and said toe extension portion extends through said center toe opening into said center opening, wherein said fastener passes through each of said housing, said heel extension portion, and said toe extension portion.

12. The golf club head of claim 11, wherein said housing comprises a first recess having a shape corresponding to said heel extension portion and a second recess having a shape corresponding to said toe extension portion.

13. The golf club head of claim 8, wherein a second fastener receiving hole is defined said toe mass portion, and a second fastener passes through a hole defined in said chassis within said toe opening and mates with threads defined in said second fastener receiving hole.

14. The golf club head of claim 8, wherein said toe mass portion includes a recess and said toe opening includes a projection, and wherein said recess and said projection constitute a dovetail joint.

15. A golf club head comprising:

a chassis including a heel, a toe opposite said heel, a topline, a sole opposite said topline, a hosel, a striking face, and a rear wall opposite said striking face;

a center opening defined in said chassis and configured to receive a housing, said center opening including a fastener receiving hole;

a toe opening defined in said toe of said chassis and configured to receive a toe weight member, said toe opening comprising:

a toe tab having grooves defined therein; and a center toe opening in communication with said center opening, wherein said toe weight member includes a toe mass portion having a shape corresponding to a shape of said toe opening, a toe extension portion extending into said center opening through said center toe opening, and a toe notch having a shape that corresponds with said toe tab;

a heel opening defined in said heel of said chassis and configured to receive a heel weight member, said heel opening comprising:

a heel tab having grooves defined therein; and a center heel opening in communication with said center opening, wherein said heel weight includes a heel mass portion having a shape corresponding to a shape of said heel opening, a heel extension portion extending into said center opening through said center heel opening, and a heel notch having a shape that corresponds with said heel tab;

said housing comprising:

a first recess having a shape corresponding to said toe extension portion;

a second recess having a shape corresponding to said heel extension portion; and an opening aligned with said fastener receiving hole defined in said chassis; and a single fastener passing through each of said opening defined in said housing, said heel extension portion, and said toe extension portion and mating with threads defined in said fastener receiving hole.

16. The golf club head of claim 15, wherein a second fastener receiving hole is defined said toe mass portion, and a second fastener passes through a hole defined in said chassis within said toe opening and mates with threads defined in said second fastener receiving hole.

17. The golf club head of claim 16, wherein said toe mass portion includes a recess and said toe opening includes a projection, and wherein said recess and said projection constitute a dovetail joint.

* * * * *